US012503328B2

(12) United States Patent
Armitano et al.

(10) Patent No.: US 12,503,328 B2
(45) Date of Patent: Dec. 23, 2025

(54) CONVERTING MACHINE WITH AUTOMATIC INSERTION OF THE MATERIAL STRIP

(71) Applicant: IMS TECHNOLOGIES S.P.A., Calcinate (IT)

(72) Inventors: Maurizio Armitano, Calcinate (IT); Isidoro Bianchi, Calcinate (IT); Daniele Rota, Calcinate (IT)

(73) Assignee: IMS TECHNOLOGIES S.P.A., Calcinate (IT)

( * ) Notice: Subject to any disclaimer, the term of this patent is extended or adjusted under 35 U.S.C. 154(b) by 221 days.

(21) Appl. No.: 18/350,882

(22) Filed: Jul. 12, 2023

(65) Prior Publication Data

US 2024/0017951 A1 Jan. 18, 2024

(30) Foreign Application Priority Data

Jul. 13, 2022 (IT) ..... 102022000014710

(51) Int. Cl.
*B65H 20/34* (2006.01)

(52) U.S. Cl.
CPC ..... *B65H 20/34* (2013.01); *B65H 2301/4165* (2013.01); *B65H 2301/52202* (2013.01); *B65H 2404/62* (2013.01)

(58) Field of Classification Search
CPC ..... B65H 2301/44332; B65H 2301/52202; B65H 2301/44712; B65H 23/26; B65H 2405/55
USPC ..... 242/532, 532.1, 532.3, 532.5, 532.7
See application file for complete search history.

(56) References Cited

U.S. PATENT DOCUMENTS

| | | | | |
|---|---|---|---|---|
| 4,309,830 | A * | 1/1982 | Vits | B65H 20/20 34/640 |
| 4,723,698 | A * | 2/1988 | Schoonderbeek | B65H 20/34 242/364.3 |
| 7,406,901 | B2 * | 8/2008 | Schmidt | D21G 9/0063 83/438 |
| 2010/0155522 | A1 * | 6/2010 | Arimitsu | B65H 35/02 242/525 |
| 2011/0057068 | A1 * | 3/2011 | Baggot | B65H 19/2276 242/526 |
| 2017/0327335 | A1 * | 11/2017 | Vergentini | B65H 23/195 |

FOREIGN PATENT DOCUMENTS

| | | | | |
|---|---|---|---|---|
| EP | 1757547 | A2 * | 2/2007 | B65H 19/1852 |
| GB | 2287242 | A * | 9/1995 | B41F 13/03 |

* cited by examiner

*Primary Examiner* — Anna M Momper
*Assistant Examiner* — Ermia E. Melika
(74) *Attorney, Agent, or Firm* — Armstrong Teasdale LLP

(57) ABSTRACT

A converting machine, or a machine for winding or unwinding a strip of material on coils or for converting coils of a material into smaller coils, is configured to process a delicate material. The machine includes a loading unit for automatically loading a strip of material into the machine, an accumulation unit for accumulating the strip being processed, and a winding unit for winding the strip on a winding shaft to form respective coils.

9 Claims, 19 Drawing Sheets

CONVERTING MACHINE WITH AUTOMATIC INSERTION OF THE MATERIAL STRIP

CROSS-REFERENCE TO RELATED APPLICATIONS

This application claims the benefit of priority to Italian Patent Application No. 102022000014710, filed on Jul. 13, 2022, the entire contents of which are hereby incorporated by reference herein.

FIELD OF THE INVENTION

The present invention relates to a converting machine, i.e., a machine for winding or unwinding a strip of material on coils, particularly configured to process a delicate material.

BACKGROUND ART

The field of converting relates to all machines performing a process of winding and unwinding a strip of material onto and from coils. Such machines perform the function of transporting the strip between one coil and another of generally different sizes in a fast and defect-free manner.

Such converting operations can consist in i) producing coils of small widths and diameters from parent coils produced in large sizes for reasons of process economy; ii) processing the material to add certain features, such as printing, lamination, or film deposition; and iii) rewinding a previously produced coil to eliminate defects.

The end product of the process is an intermediate step in the processing chains of all materials, such as paper, plastics, aluminum, and laminates, made in the form of films, generally of a thickness between a few microns and one millimeter. Converting machines are used in multiple industrial fields, including the food packaging and automotive industries, for example.

However, in some application fields, a highly delicate and/or brittle, very thin and/or loosely cohesive, and thus easily flaky, material needs to be subjected to converting. In these cases, managing the converting activity can be problematic and negatively affect the operational speed of the entire process.

When the strip to be converted consists of such a material, the processing thereof should normally include special precautions to avoid the strip from breaking, which would cause the system to stop. A particularly critical step is at the start of processing, when a new coil of material, usually a large one, is to be fed into the converting machine which will reduce it into smaller coils. This step is difficult to automate because the strip could be subjected to unacceptable rips and tears. This all results in slowing down the production process and the need for more labor resulting in higher production costs.

When the converting machine also comprises a section acting as a storage store for the strip being processed (so as to obviate any downstream downtime), another critical step is the operation of the store section during the initial step of loading the strip being processed into the machine, in particular when the moving strip comes into contact with non-moving parts. Indeed, in such cases there may be a risk of strip breakage or tearing.

The need is thus felt to provide a machine for converting coils of delicate and/or brittle material which preserves high productivity and minimizes possible interruptions caused by material breakage.

SUMMARY OF THE INVENTION

Such a problem is solved by a machine for converting coils of delicate and/or brittle material as defined in the appended claims, the definitions of which are an integral part of the present description.

In particular, the invention relates to:

1) a machine for converting coils of a material into smaller coils, comprising a loading unit for automatically loading a strip of material into the machine, an accumulation unit of the strip being processed, and a winding unit of the strip on a winding shaft to form respective coils (B), characterized in that the loading unit comprises an accompanying system for the strip from the loading unit to the winding unit, said accompanying system consisting of a double chain, comprising a first chain and a second chain and an accompanying bar driven by said first and second chains, wherein the double chain develops in a loop along a path and wherein the accompanying bar is movable along said loop-shaped path and is configured to drive the strip from the loading unit to the winding unit and then, after releasing the strip, to return to the starting point in the loading unit;
2) a machine according to 1), wherein the path is defined by a plurality of idle toothed wheels and at least one motorized toothed wheel;
3) a machine according to 1) or 2), wherein the accompanying bar is cylindrical in shape, i.e., has a circular section, or at least comprises a surface with an arc-of-a-circle-shaped section facing the sliding direction of the double chain, and is made of, or comprises parts made of, a ferromagnetic material so as to be attracted by a magnet;
4) a machine according to 3), wherein the accompanying system further comprises a non-motorized magnetic bar, which slides idly along the path, the magnetic bar being associated with a C-shaped element, having a cross-section with a concave profile so as to couple to the accompanying bar during the operational steps of the method of loading a new strip;
5) a machine according to 4), wherein, in a resting condition, the magnetic bar is housed in a locking-unlocking device, from which it is picked, during the step of loading the strip, by the accompanying bar, so as to be pushed along the path;
6) a machine according to 5), wherein the locking-unlocking device of the magnetic bar comprises a lever element comprising a body, from a first end of which a locking finger protrudes, arranged along an axis inclined at an angle of less than 90° with respect to the longitudinal axis of the body, the body being hinged, at a midpoint, on a hinge, while, at a second end, the body is fixed to a supporting element of the locking-unlocking device by means of an elastic element, so that the lever element can pivot between an unlocked position and a locked position of the magnetic bar, wherein the lever element is returned to the locked position by the elastic recall of the elastic element;
7) a machine as in any one of 1) to 6), wherein the accumulation unit comprises:

a first movable supporting structure for a first series of movable rollers and a second movable supporting structure for a second series of movable rollers, wherein each series of movable rollers comprises a plurality of rollers aligned vertically in a plane parallel to a first and a second straight path stretch, said first and second straight path stretches being connected by a third upper path stretch, to form as a whole a substantially n-shaped path stretch, which encloses said movable supporting structures underneath, and wherein said first and second movable supporting structures slide in opposite directions away from each other;

a first series of fixed rollers and a second series of fixed rollers, facing the first and second series of movable rollers, respectively, but staggered vertically with respect thereto, each series of fixed rollers comprising a plurality of vertically aligned rollers on a plane parallel to said first and second path stretches and facing one side of said path stretches opposite to said first and second series of movable rollers, i.e., on the outside of the n-shaped path stretch, so that said path stretches are placed between said fixed rollers and said movable rollers;

8) a machine as in 7), wherein the fixed rollers and the movable rollers are idle and are vertically spaced apart by the same spacing, and wherein the fixed rollers are vertically offset with respect to the movable rollers so that when the latter are placed in an extended position, they fit between two fixed rollers without interfering therewith;

9) a machine according to any one of 1) to 8), wherein the winding unit comprises a roller for feeding the strip to a winding position and a rotatable disc which supports two coil winding shafts, the winding shafts being, in turn, rotational in a motorized manner, wherein the winding shafts are placed in opposite positions along one diameter of the disc, so that the 180° rotation of the disc takes the first or second winding shaft alternatively to said winding position.

The invention further relates to a method for converting a coil of material wound as a strip into coils of smaller size, where said material is preferably a delicate, brittle and/or loosely cohesive material, comprising the steps of:

a) providing a converting machine as defined in any one of 1) to 9);

b) moving the accompanying bar forward until it comes into contact with an end portion of the strip (N) and transporting the end portion of the strip against the magnetic bar so as to sandwich it between the accompanying bar and the C-shaped element of the magnetic bar;

c) moving the accompanying bar—magnetic bar assembly forward together with the strip along said path through the accumulation unit up to the winding unit;

d) separating the end portion of the strip from the rest of the strip, which is subjected to winding on a winding shaft;

e) moving the accompanying bar-magnetic bar assembly forward together with a piece separated from the strip along the path until it returns to the loading unit at the locking-unlocking device;

e) moving the accompanying bar with retrograde motion so that it takes an initial starting position.

Further features and advantages of the present invention will become more apparent from the description of certain embodiments thereof, given below only by way of a non-limiting indication, with reference to the enclosed figures.

DETAILED DESCRIPTION OF THE INVENTION

Figure 1:
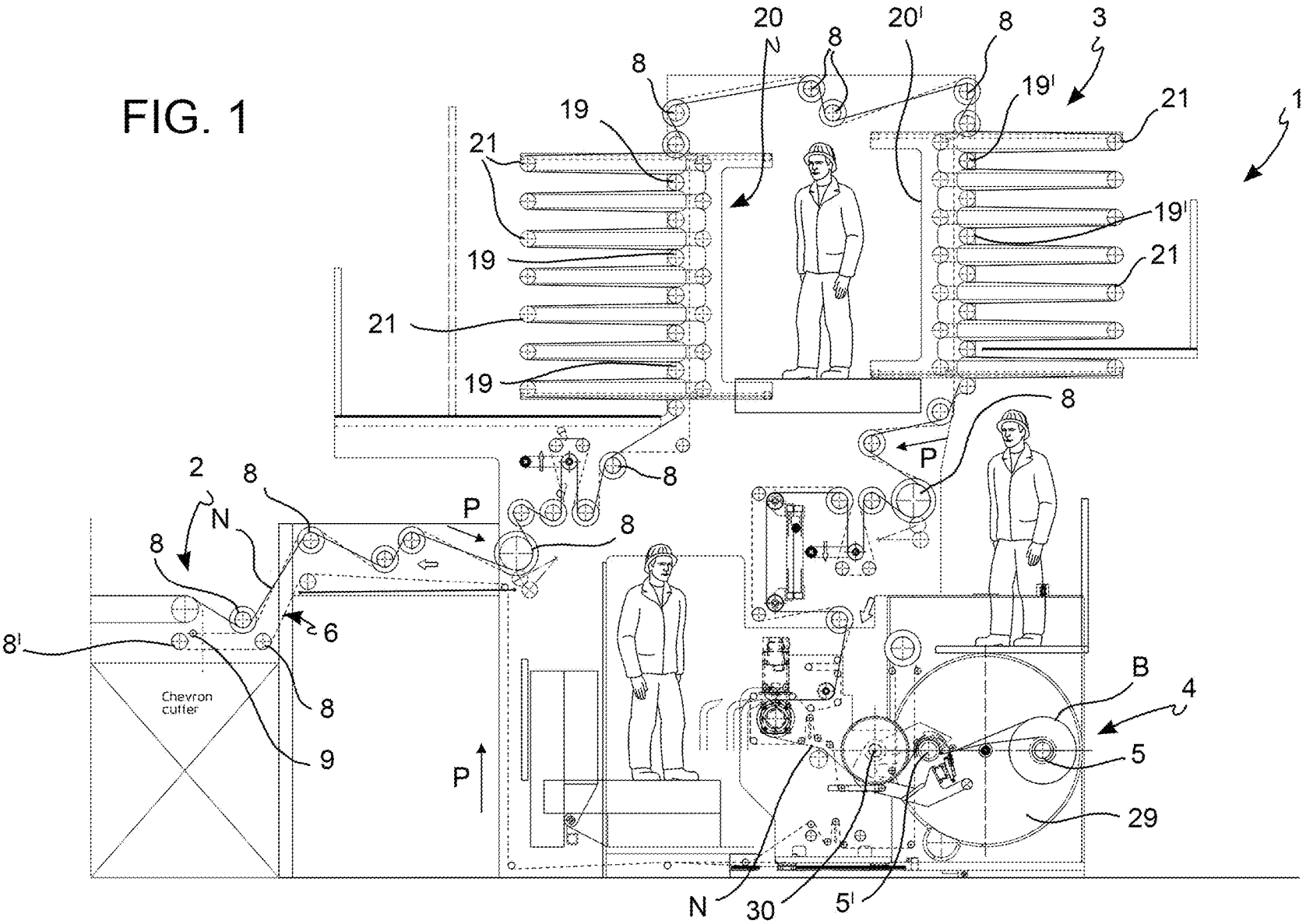
FIG. 1 is a diagrammatic side section view of the machine according to the present invention.

The converting machine according to the invention, indicated by reference numeral 1 as a whole, comprises a loading unit 2 of the strip N of material, an accumulation unit 3 of the strip N being processed, and a winding unit 4 of the strip N on a winding shaft 5' to form respective coils B.

As mentioned above, the step of inserting the strip N into machine 1 is a critical step and requires special precautions to be carried out automatically.

The loading unit 2 of the strip N comprises the accompanying system 6 for the strip N along the various working steps of the machine 1, i.e., from the loading unit 2 to the accumulation unit 3 and the winding unit 4. The accompanying system 6, shown in FIG. 1 with a dotted line, consists of a double chain 7 (diagrammatically shown in the figures with a single line) which develops in a loop along a path P defined by a plurality of idle toothed wheels 8 and at least one motorized toothed wheel 8'. The double chain 7 movably supports an accompanying bar 9, which is thus movable along the loop-shaped path P and is configured to drive the strip N to be loaded into the machine 1 from the loading unit 2 to the winding unit 4 and then, after releasing the strip N, to return to the starting point in the loading unit 2.

The accompanying bar 9 is preferably cylindrical in shape, i.e., it has a circular section or at least comprises a surface with an arc-of-a-circle-shaped section facing the sliding direction of the double chain 7. The accompanying bar 9 is also made of, or comprises parts made of, a ferromagnetic material so as to be subjected to attraction by a magnet.

As shown in FIGS. 2-11, the accompanying system 6 also comprises a non-motorized magnetic bar 10, which idly slides along the path P on appropriate guides. A C-shaped element 10*a*, having a cross-section with a concave profile, is associated with the magnetic bar 10 in order to be coupled to the accompanying bar 9 during the operational steps of the method of loading a new strip N.

In a resting condition, the magnetic bar 10 is housed in a locking-unlocking device 11, from which it is picked, during the step of loading strip N, by the accompanying bar 9, so as to be pushed along the path P, as will be described below.

Figure 2:
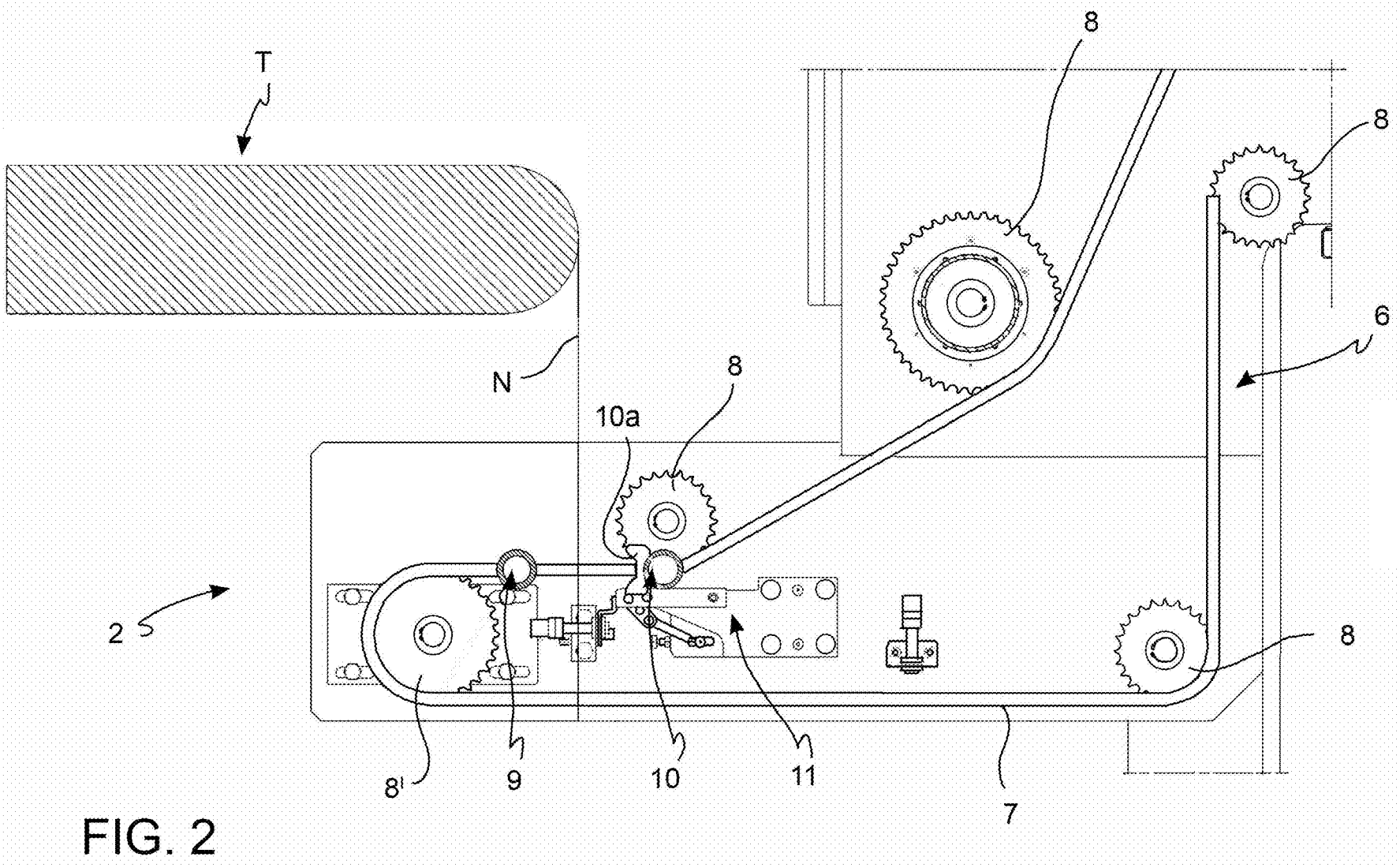
FIGS. 2-7 and 10-11 are diagrammatic side section views of the automatic strip loading system of the machine in FIG. 1, according to an operational sequence.
Figure 3:
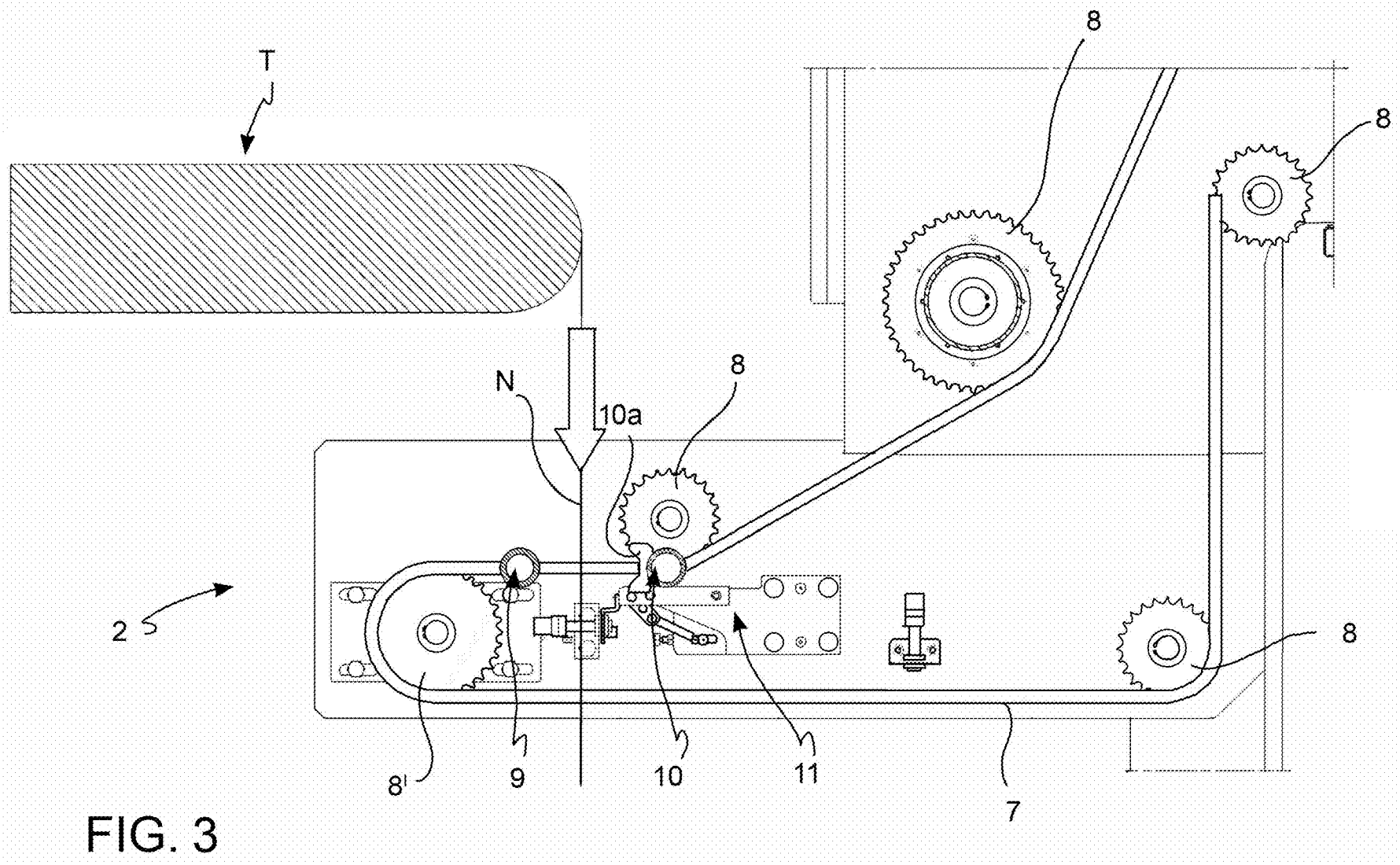

In a first step of loading a new strip N, the strip N from a large coil upstream (not shown) is fed to the loading unit 2 of the machine 1 by means of a conveyor T and falls vertically, as shown in FIGS. 2 and 3, positioning itself in the space between the accompanying bar 9 and the magnetic bar 10.

Figure 4:
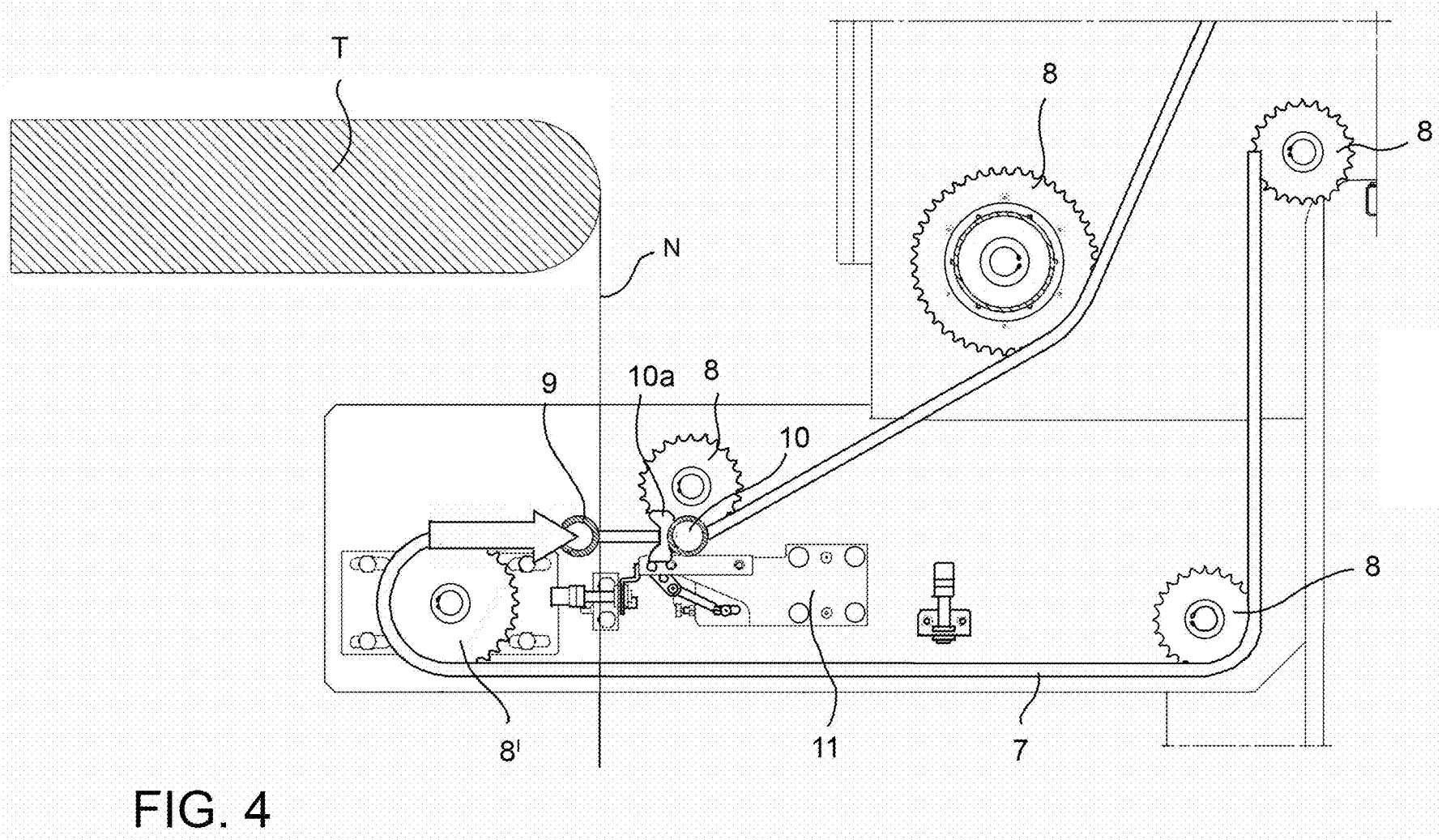
Figure 5:
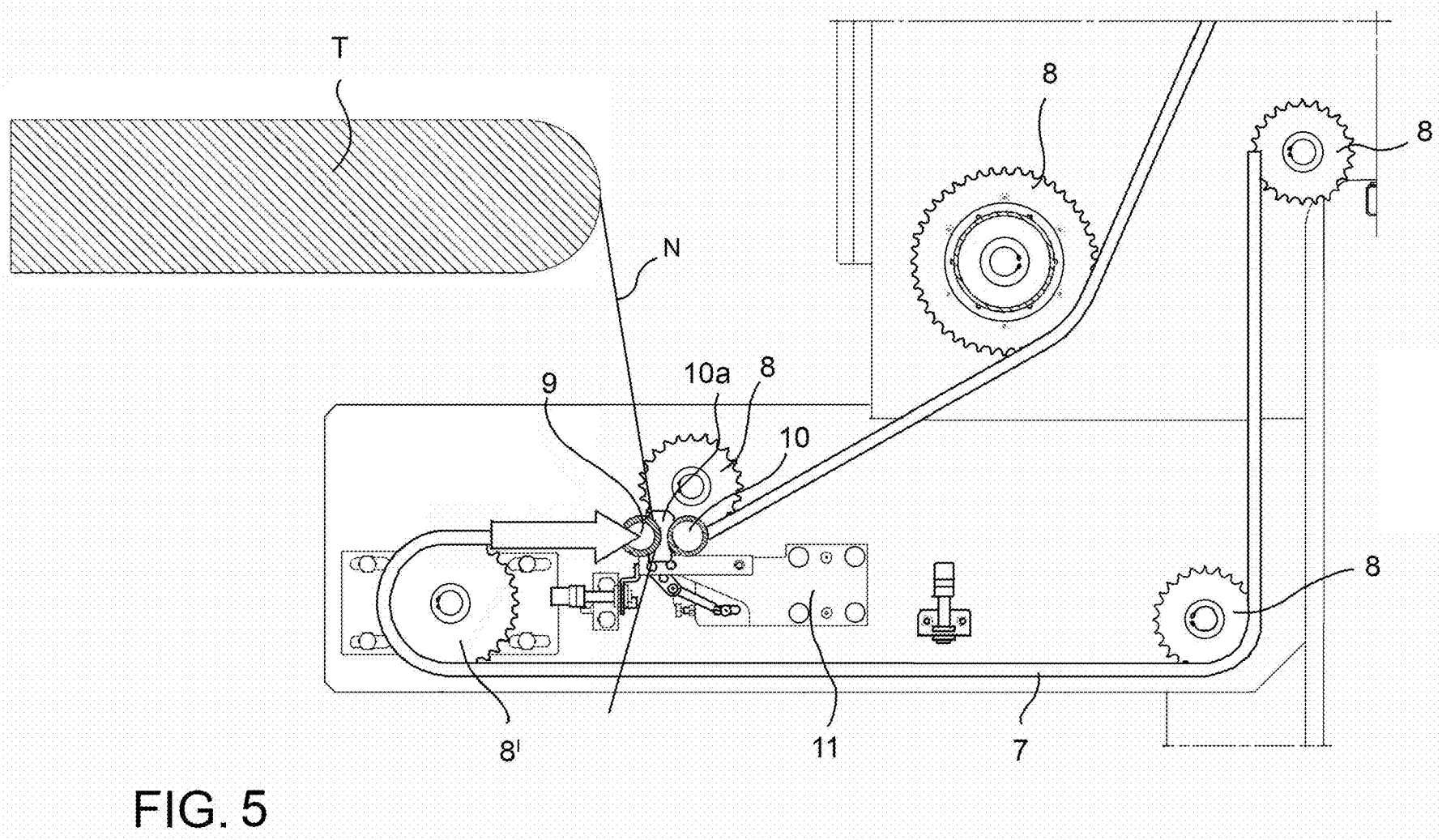

FIGS. 4 and 5 show the next step, in which the double chain 7 is set in motion along the direction of the arrow, so that the accompanying bar 9 comes into contact with an end portion of the strip N until it is sandwiched between the accompanying bar 9 and the C-shaped element 10*a* of the magnetic bar 10. The magnetic attraction between the magnetic bar 10 and the accompanying bar 9 allows holding the strip N firmly close to one end thereof and leading it along the path P in a gentle manner, i.e., without the use of gripper systems which would damage the strip N and cause it to break.

Figure 6:
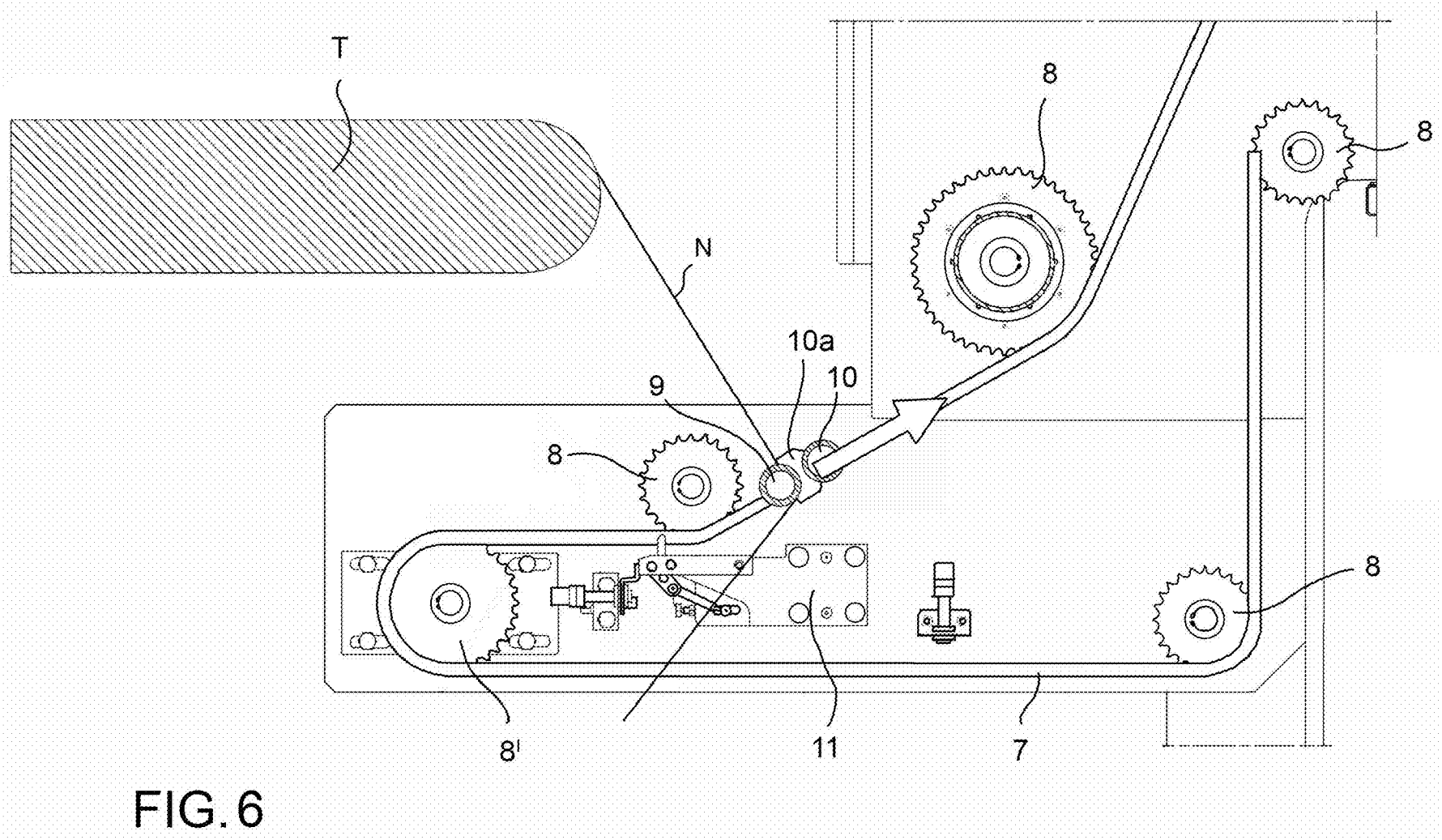
Figure 7:
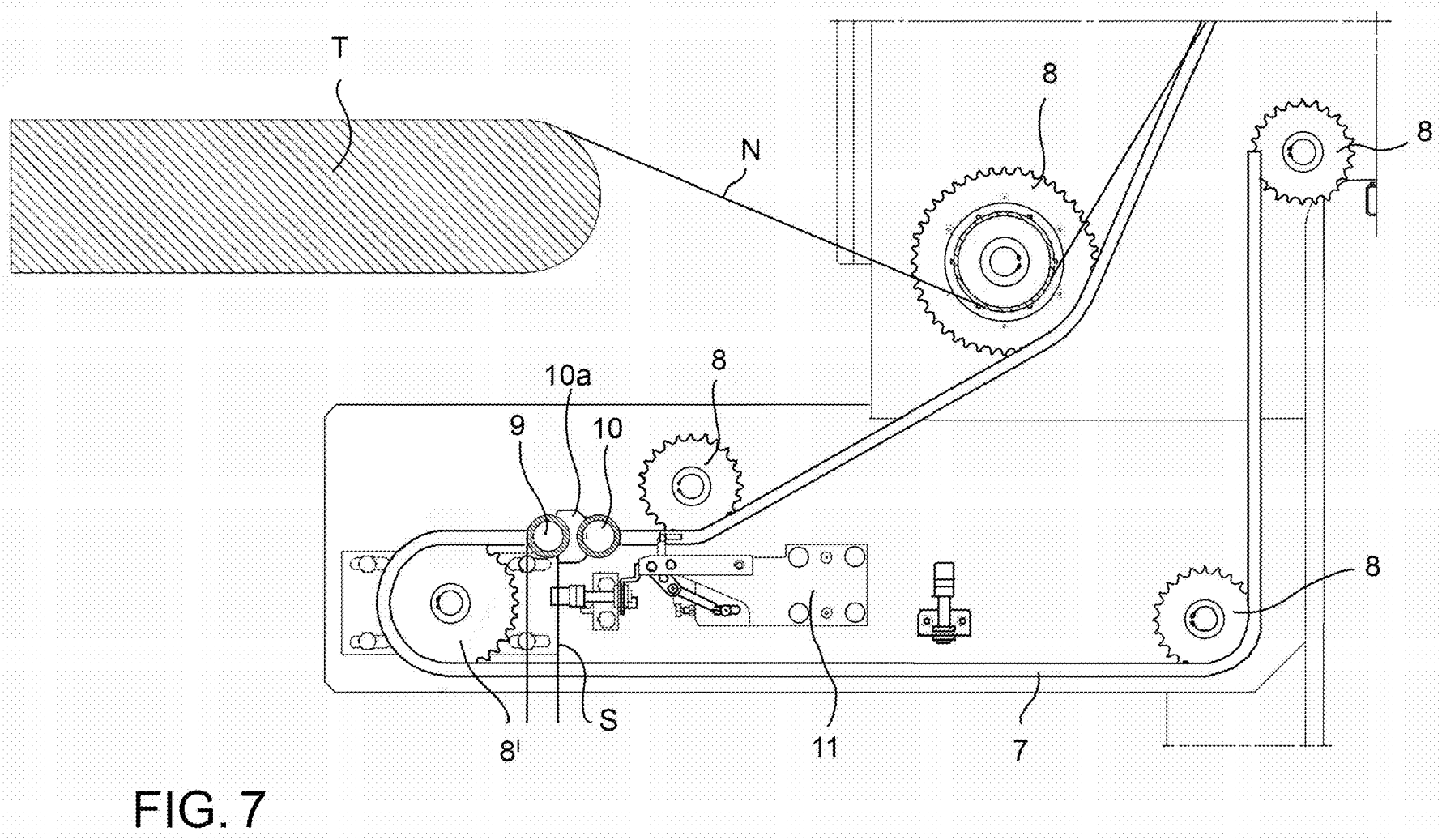

When the accompanying bar 9 is in the position in FIG. 5, the movement thereof along the path P causes the magnetic bar 10 to be unlocked by the locking-unlocking device 11, as will be described below, whereby the accompanying bar 9—magnetic bar 10 assembly together with the strip N continues to travel along said path P, as shown in FIG. 6. In practice, the strip N is driven by the accompanying bar 9 and the magnetic bar 10 through the accumulation unit 3 (which will be described below), then into the winding unit 4, where the end portion of the strip N is separated from the rest of the strip N, which then begins to be wound on a winding shaft 5, 5', thus continuing the converting operation. The bars 9, 10, associated with the piece S of strip N, continue along the path P until they return to the loading unit 2, as shown in FIG. 7.

The accompanying bar 9 continues the motion thereof until it reaches the locking-unlocking device 11. The locking-unlocking device 11 of the magnetic bar 10 comprises a lever element 12 comprising a body 12*a*, from a first end of which a locking finger 12*b* protrudes, arranged along an axis X inclined at an angle less than 90° with respect to the longitudinal axis Y of the body 12*a*. The body 12*a* is hinged, at a midpoint, on the hinge 13, while at the second end opposite to that on which the locking finger 12*b* is placed, the body 12*a* is fixed to a first end of an elastic element 14, the second end of which is fixed to a supporting element 15 of the locking-unlocking device 11. The lever element 12 can thus pivot between an unlocking position (FIG. 8) and a locking position (FIG. 9) of the magnetic bar 10, in which the lever element 12 is returned to the locking position by the elastic recall of the elastic element 14.

The elastic element 14, as shown in the figures, can be a conventional coil spring.

The supporting element 15 is adjustable along an axis Q incident with the longitudinal axis Y of the lever element 12 so as to adjust the tensioning of the elastic element 14. For that purpose, the supporting element 15 comprises an adjustment screw 16 coaxial to the axis Q, inserted into a threaded sleeve 18 coupled to a hole made in the supporting element 15, the adjustment screw 16 ending inside the supporting element 15 with a distal end 16*a* being on a fixed pin 17. Since the screwing or unscrewing of the adjustment screw 16 cannot cause it to advance or retract due to the constraint with the fixed pin 17, it causes the supporting element 15 to be displaced along the axis Q and thus the tensioning or detensioning of the elastic element 14.

Figure 8:
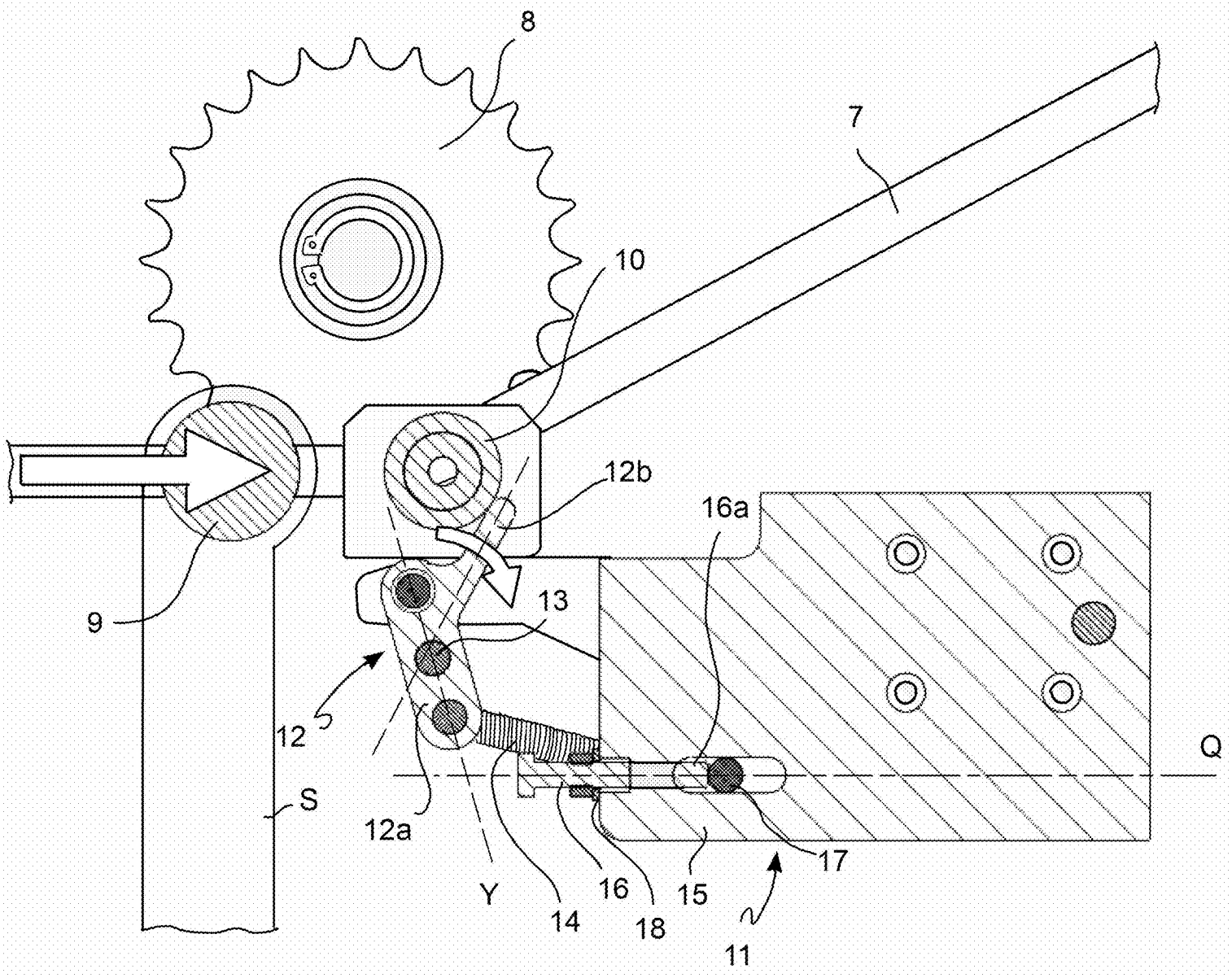
FIGS. 8 and 9 are diagrammatic side section views of a detail of the system in FIGS. 2-7, in two different operational steps.
Figure 9:
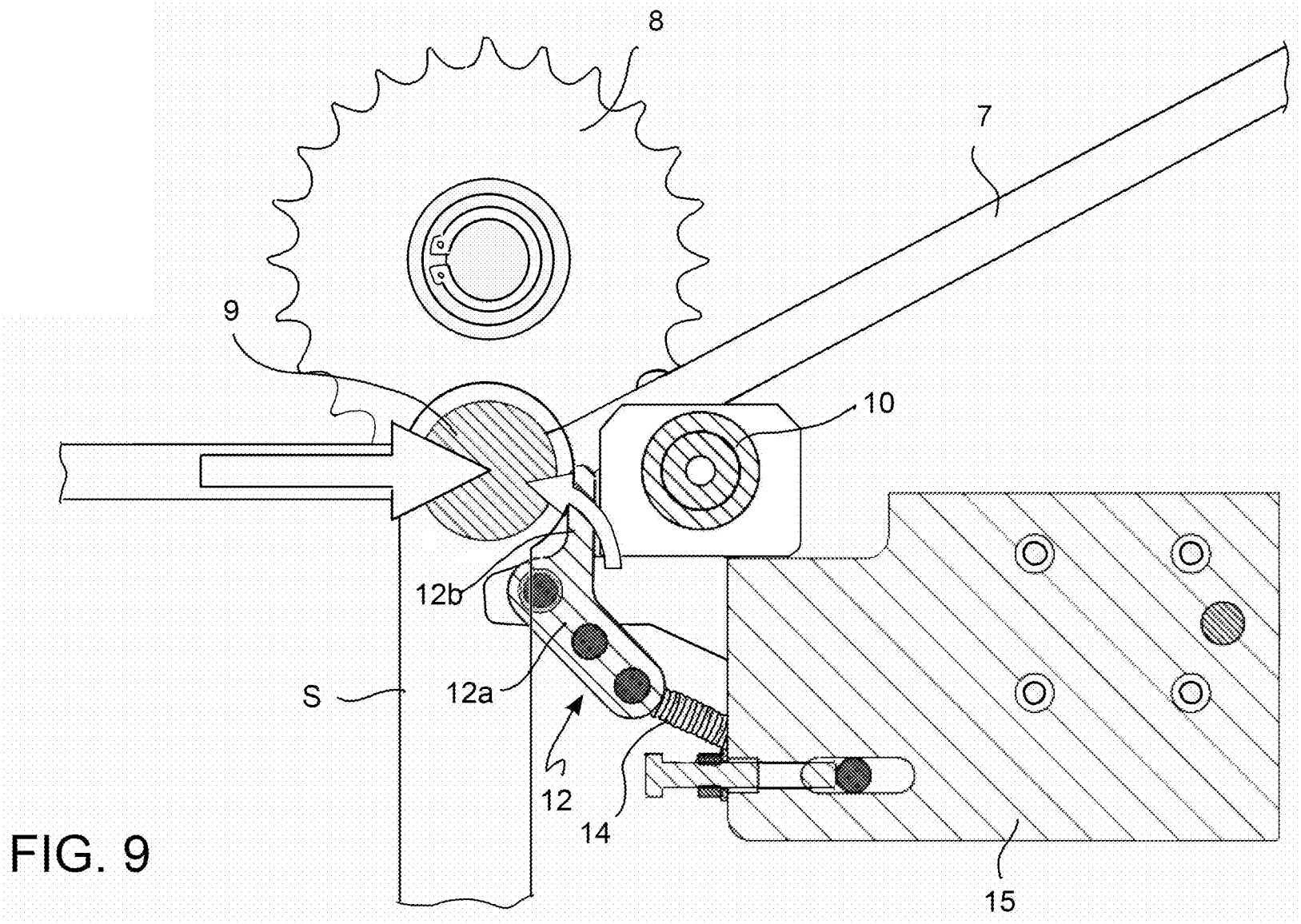

As shown in FIGS. 8 and 9, the accompanying bar 9 pushes the magnetic bar 10 to abut against the locking finger 12*b*, thus rotating the lever element 12 in the direction of the arrow in FIG. 8. Then, when the magnetic bar 10 has passed the locking finger 12*b*, the lever element 12 is called back to the locking position by the elastic element 14, so that the locking finger 12*b* is interposed between the magnetic bar 10 and the accompanying bar 9.

Figure 10:
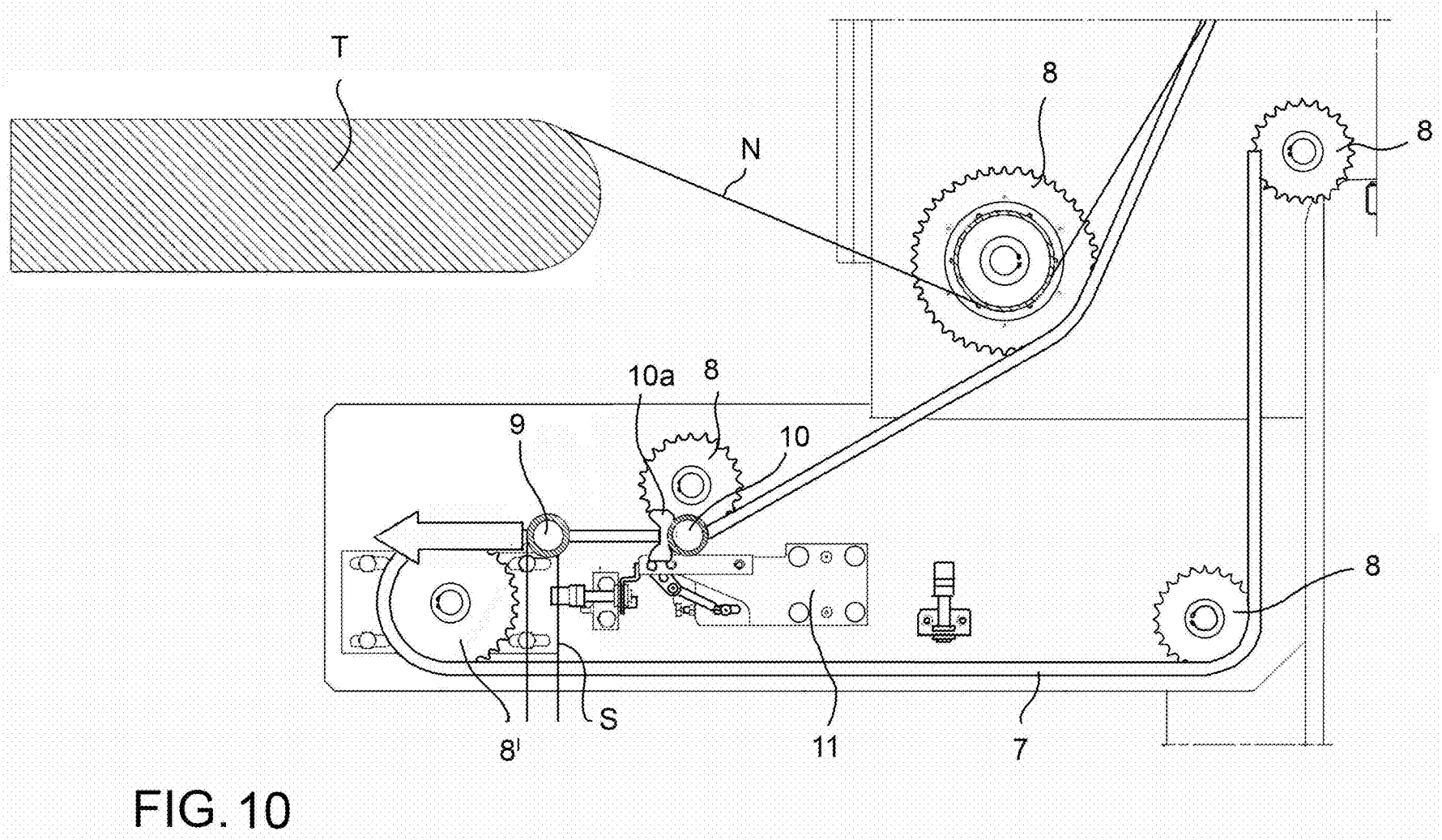
Figure 11:
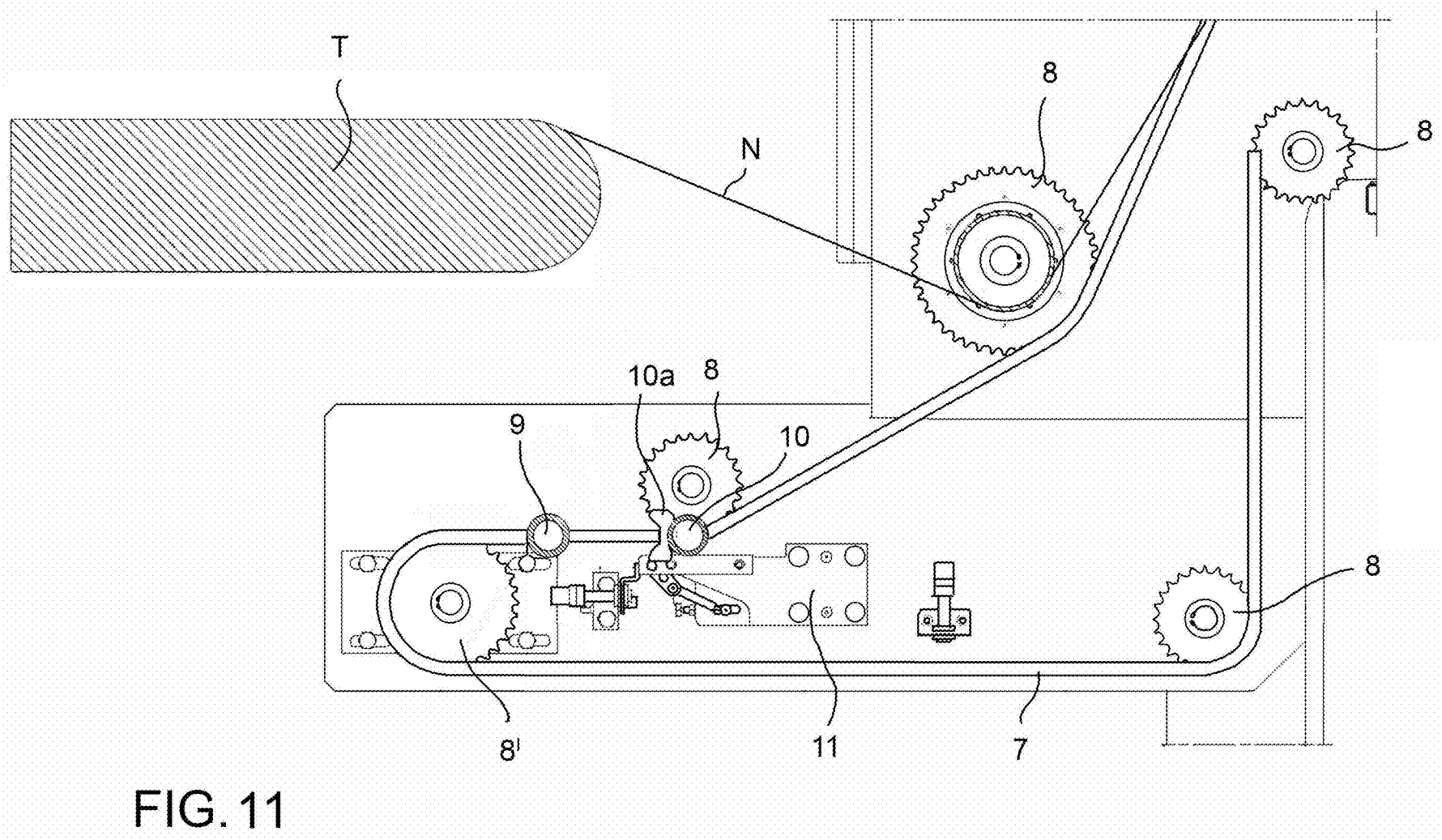
Figure 12:
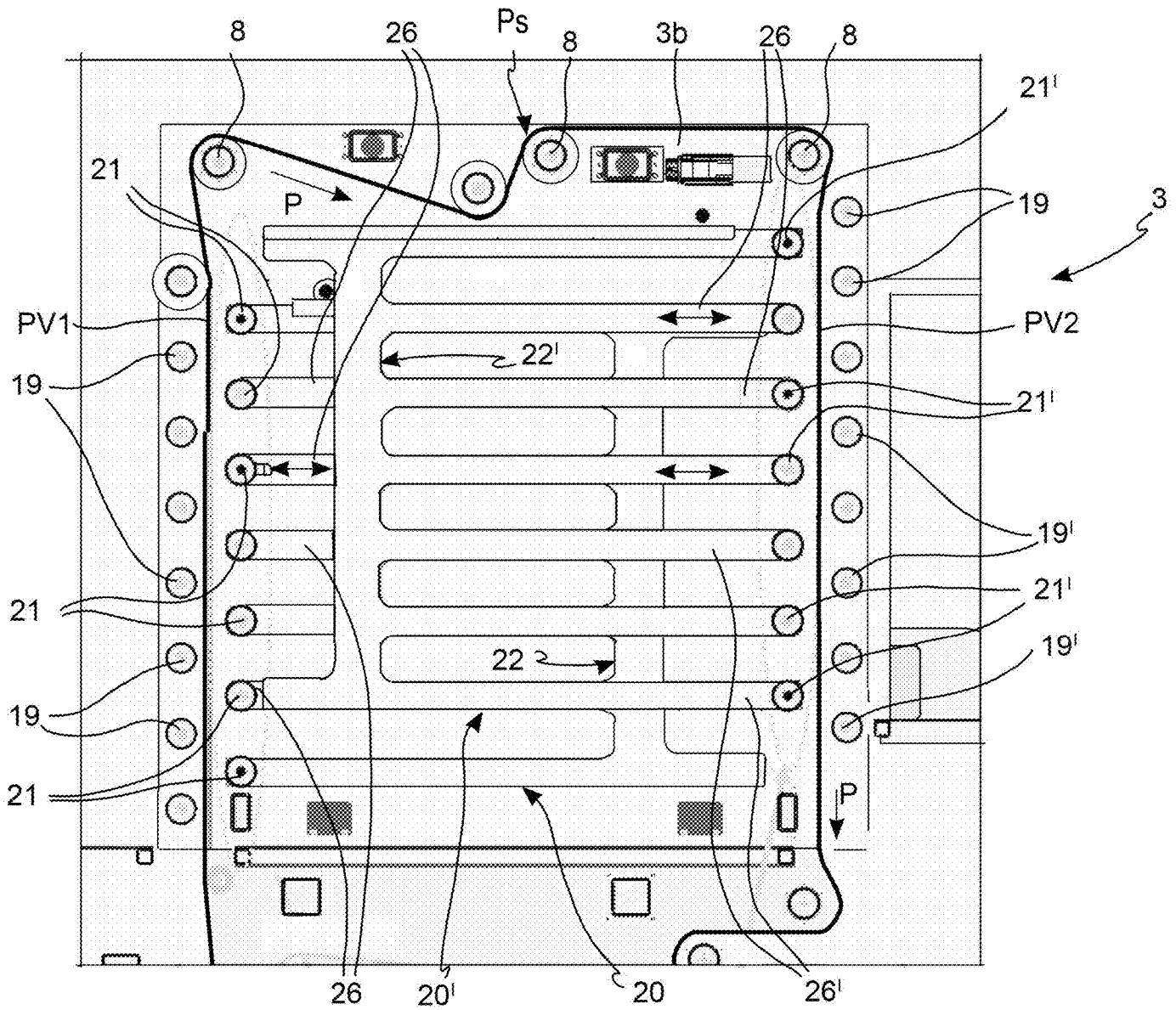
FIG. 12 is a diagrammatic side section view of the storage store in FIG. 1.

FIG. 10 shows the next step of the loading operation of the strip N, in which the accompanying bar 9 reverses its motion, taking a retrograde motion that brings it to the initial position thereof. Once the accompanying bar has been released from the piece S of strip N (FIG. 11), the loading unit 2 is ready for loading the strip N from a subsequent source coil.

The operations in FIGS. 7-11 occur simultaneously with the normal operation of the converting machine 1, i.e., converting the strip N from an upstream coil to smaller coils B downstream.

The accumulation unit 3 is placed between the loading unit 2 and the winding unit 4 of the strip N on a winding shaft 5, 5'. The accumulation unit 3 acts as a buffer store when it is necessary to replace a fully wound coil B in the winding unit 4 with a winding shaft 5' to be wound. Such an operation requires a temporary stop of the winding, therefore the accumulation unit 3 allows not interrupting the feeding of strip N from the conveyor T during such a stop.

As shown in FIGS. 12 and 17-19, the accumulation unit 3 comprises a first and a second panel 3*a*, 3*b*, said panels 3*a*, 3*b* being arranged facing each other so as to enclose therebetween a first movable supporting structure 20 for a first series of movable rollers 21 and a second movable supporting structure 20' for a second series of movable rollers 21'. Each series of movable rollers 21, 21' comprises a plurality of vertically aligned rollers in a plane parallel to a first and a second straight path stretch Pv1, Pv2. Said first and second straight path stretches Pv1, Pv2 are connected by a third upper path stretch Ps, to form as a whole a substantially n-shaped stretch of path P, which encloses said movable supporting structures 20, 20' of the movable rollers 21, 21' underneath.

Each of the movable supporting structures 20, 20' comprises a pair of comb-shaped supports 22, 22' arranged parallel to each other and to the respective panels 3*a*, 3*b* and each comprising a plurality of horizontal arms 26, 26', where the horizontal arms 26 of the first pair of comb-shaped supports 22 face the first straight stretch Pv1 of path P and the horizontal arms 26' of the second pair of comb-shaped supports 22' face the second straight stretch Pv2 of the path P.

Each movable roller 21 of the first movable supporting structure 20 is supported in an idle manner by pins 27 at the distal end of a pair of horizontal arms 26 extending from the respective pair of comb-shaped supports 22. Similarly, each movable roller 21' of the second movable supporting structure 20' is supported in an idle manner by pins 27 at the distal end of a pair of horizontal arms 26' extending from the respective pair of comb-shaped supports 22'.

Figure 17:
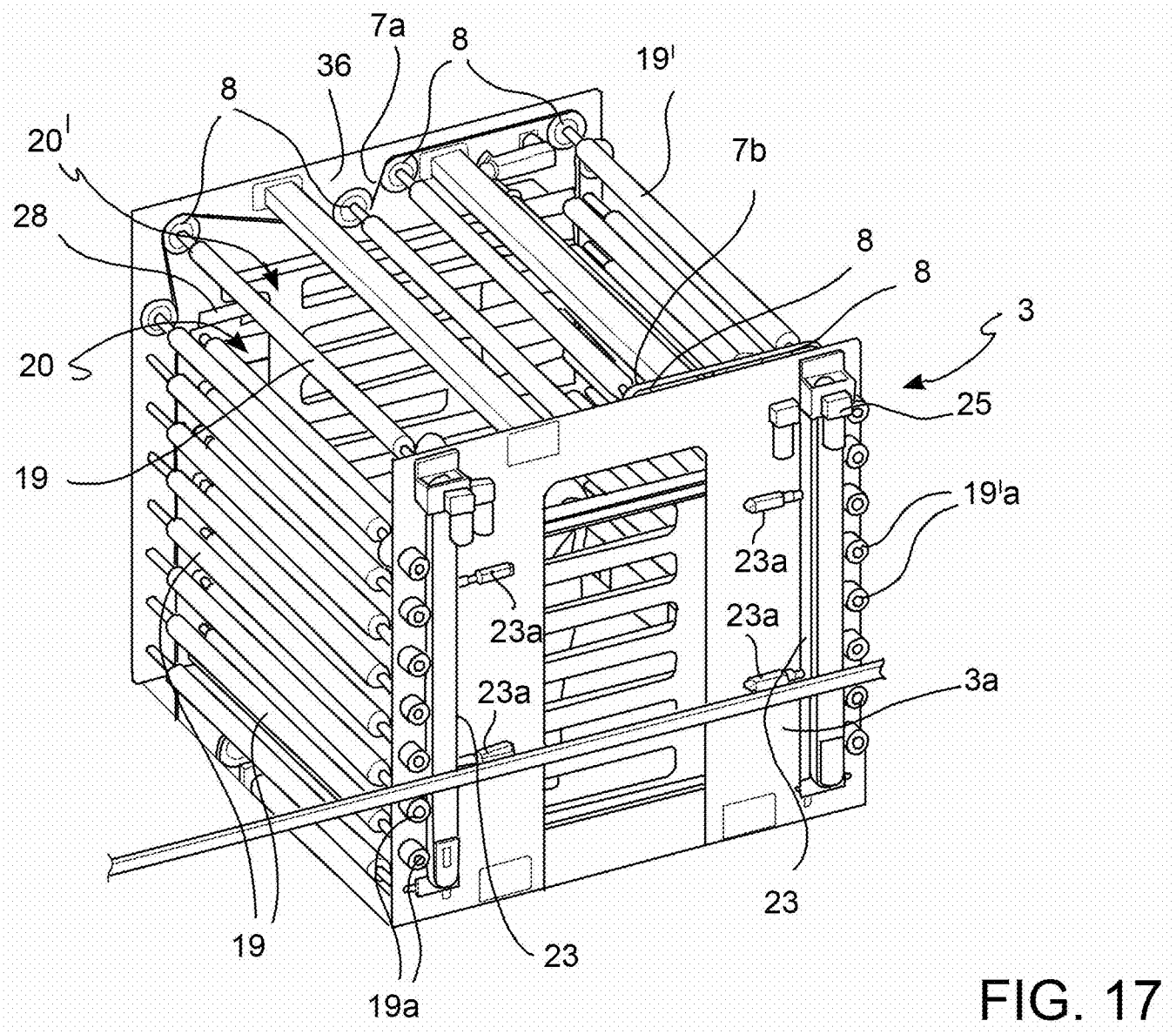
FIG. 17 is a perspective view of the storage store in a non-operational condition.

The movable supporting structures 20, 20' horizontally slide on appropriate shoe 28 (only the portion of one shoe 28 for the movable supporting structure 20 can be seen in FIG. 17) by means of appropriate motorization (not shown). The movable supporting structures 20, 20' are movable in a mutually opposite direction, as indicated by the arrows in FIG. 12, between a retracted position, in which the movable rollers 21, 21' are not in contact with the strip N, and a plurality of extended positions, in which the movable rollers 21, 21' are in contact with the strip N.

Figure 18:
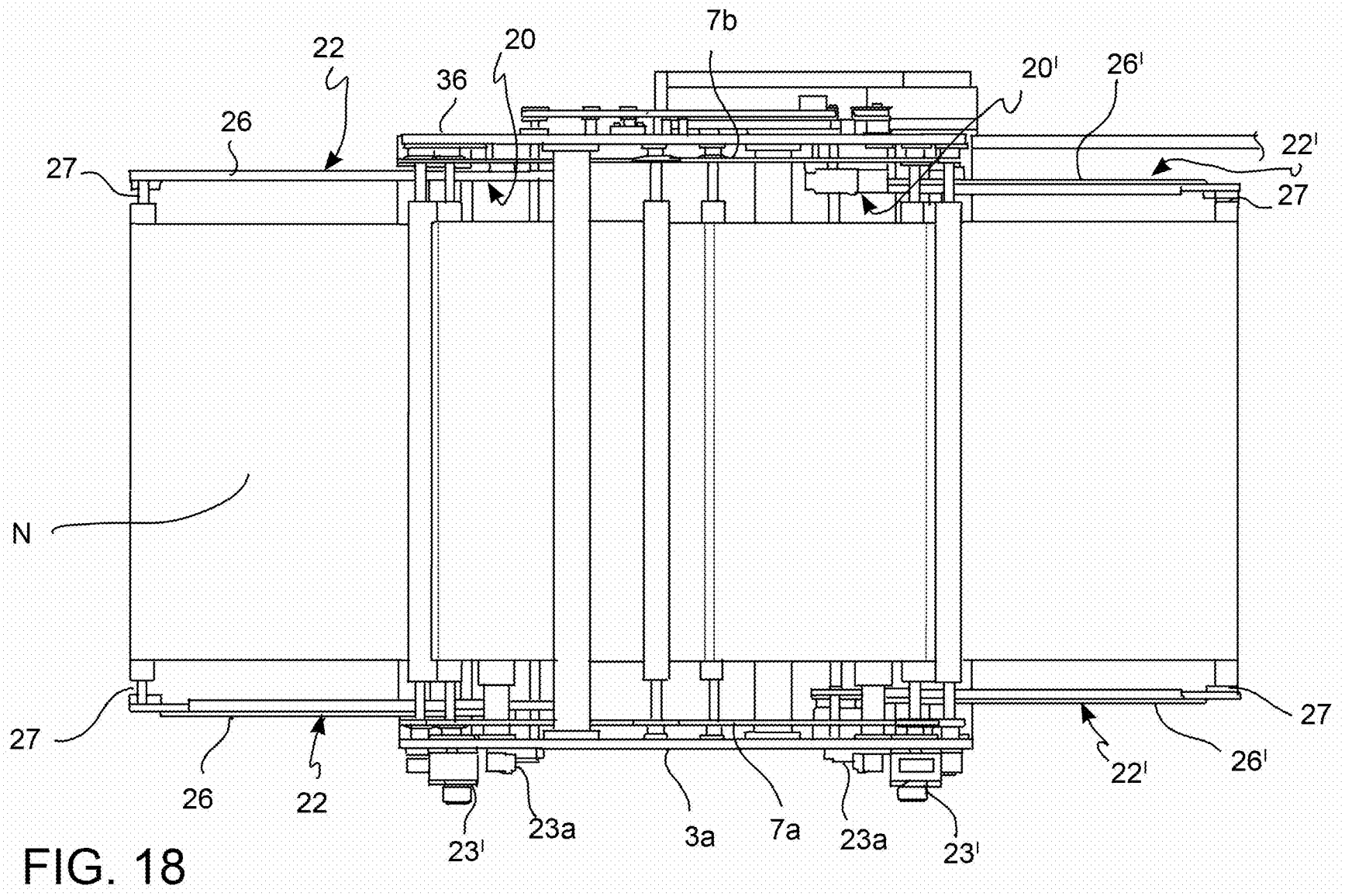
FIG. 18 is a top view of the storage store in an operational condition.
Figure 19:
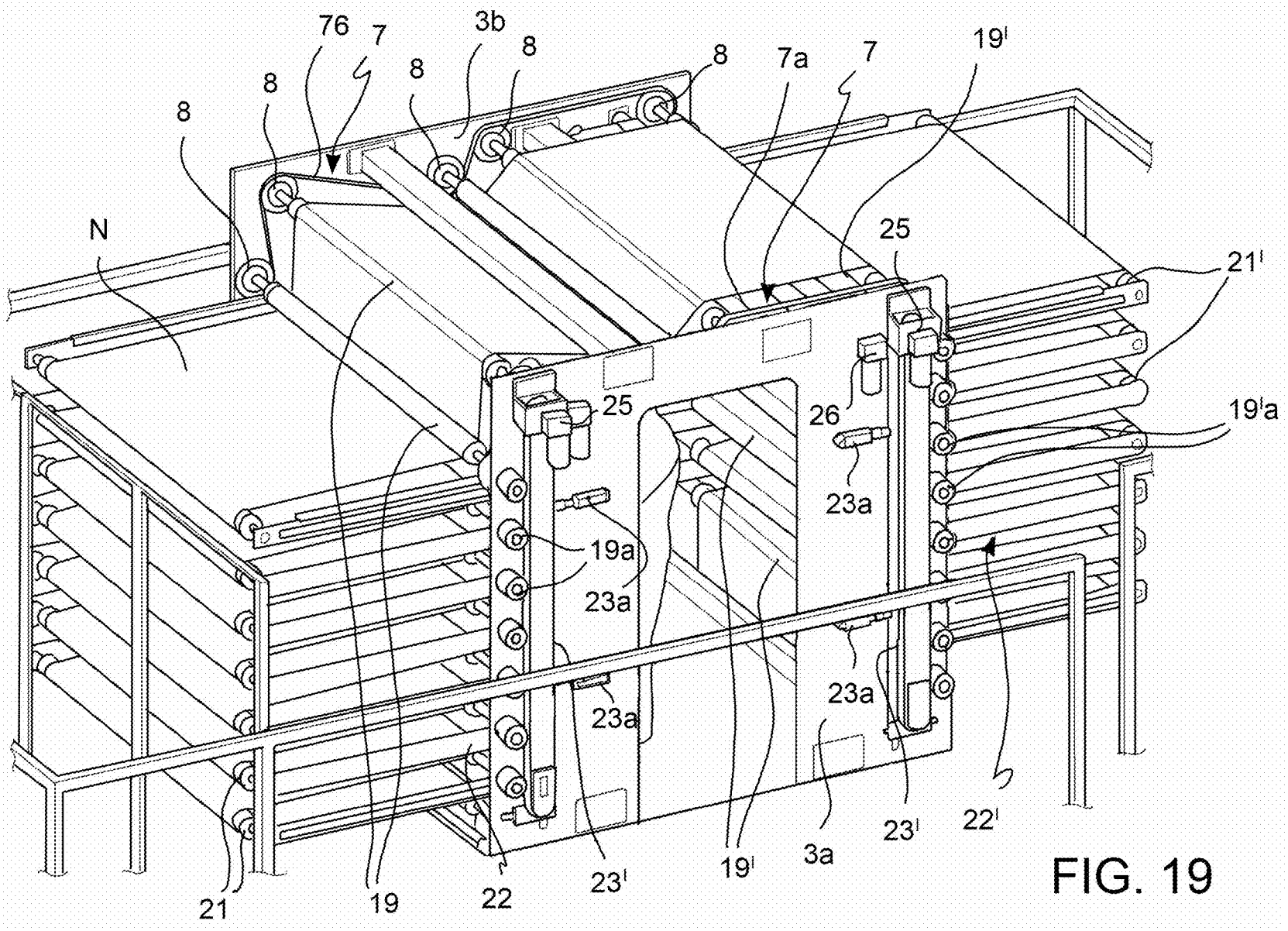
FIG. 19 is a perspective view of the storage store in an operational condition.

As shown in FIG. 18, the spacing between the two comb-shaped supports 22 of the first supporting structure 20 is greater than the spacing between the two comb-shaped supports 22' of the second supporting structure 20', so that when said supporting structures 20' slide in opposite directions, they do not interfere with each other. Moreover, as can be seen from the figures, the first and second movable supporting structures 20, 20' are vertically offset by a distance such that all the horizontal arms 26, 26' but one end arm 26, 26' are on the same horizontal plane.

The inner surfaces of panels 3*a*, 3*b*, i.e., those facing each other, also support the double chain 7, in particular a first panel 3*a* supports a first chain 7*a* of the double chain 7 and the related idle toothed wheels 8, while the second panel 3*b* supports the second chain 7*b* of the double chain 7 and the related idle toothed wheels 8.

The accumulation unit 3 further comprises a first series of fixed rollers 19 and a second series of fixed rollers 19', facing the first and second series of movable rollers 21, 21', respectively, but vertically staggered with respect thereto. Each series of fixed rollers 19, 19' comprises a plurality of vertically aligned rollers, respectively, in a plane parallel to said first stretch Pv1 and second stretch Pv2 of the path P and facing one side of said path stretches Pv1, Pv2 opposite to the first and second series of movable rollers 21, 21', i.e., outside of the n-shaped path stretch P, so that said path stretches Pv1, Pv2 are placed between said fixed rollers 19, 19' and said movable rollers 21, 21'.

The fixed rollers 19, 19' and movable rollers 21, 21' are idle and are vertically spaced by the same spacing, where the fixed rollers 19, 19' are vertically offset with respect to the movable rollers 21, 21' so that when the latter are placed in an extended position, they fit between two fixed rollers 19, 19' without interfering therewith.

Both the fixed rollers 19, 19' and the movable rollers 21, 21' preferably comprise a surface made of elastic material, typically rubber, so as to come into contact with the strip N without causing damage thereto.

The accumulation unit 3 further comprises a launching system 23 of the fixed rollers 19, 19' and a launching system 24 of the movable rollers 21, 21'. The launching systems 23, 24 have the function, in the step of loading the strip N, of causing said rollers 19, 19', 21, 21' to take a tangential velocity substantially equal to the sliding velocity of the strip N along the path P. This contrivance is very important when the strip N is made of a brittle, loosely cohesive, easily flaky material, since the contact of the moving strip N with the stationary (i.e., not rotating) rollers 19, 19', 21, 21' could easily cause the strip N to tear.

Figure 13:
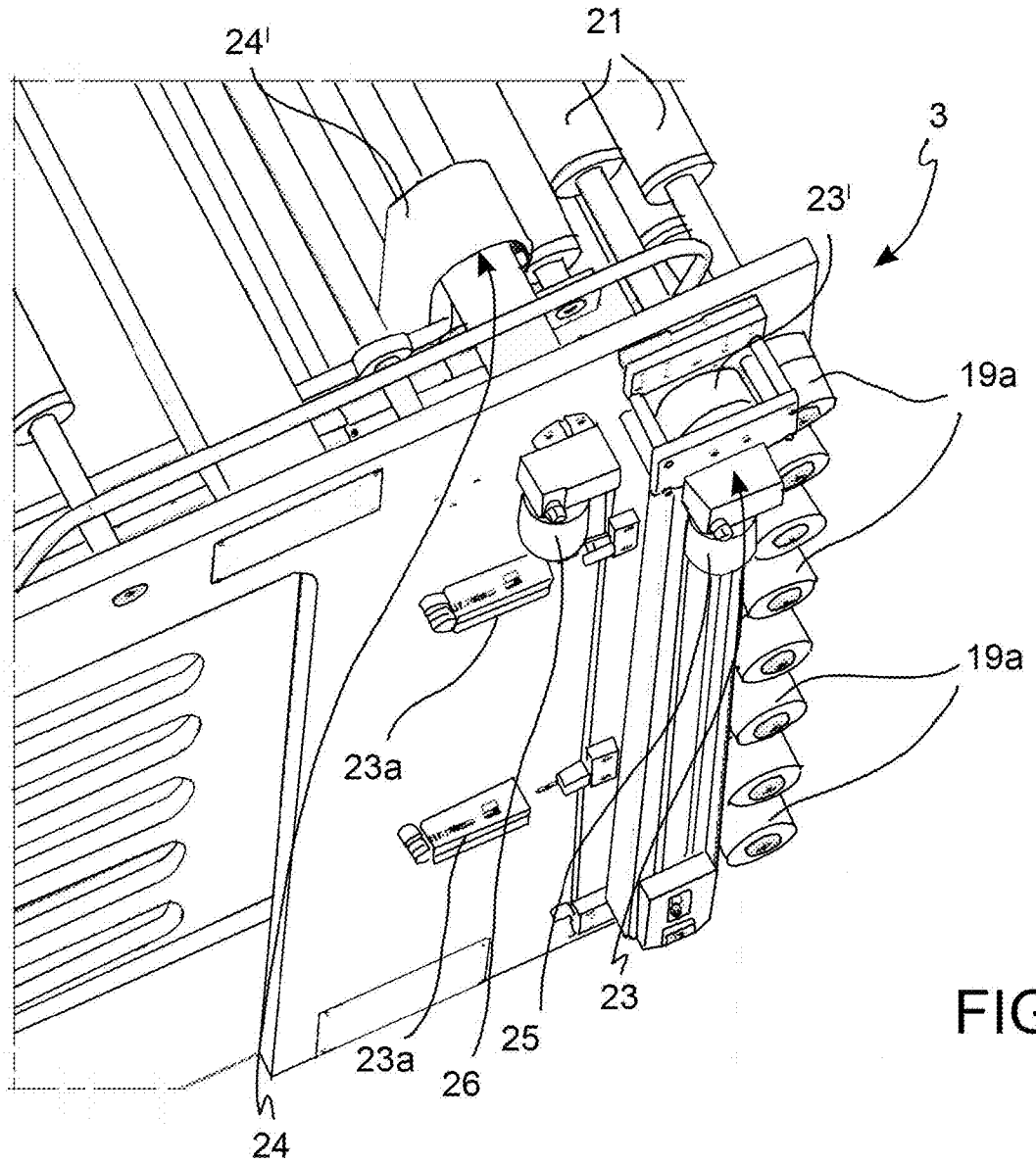
FIG. 13 is a perspective view of a detail of the storage store in FIG. 12.

The launching system 23 of the fixed rollers 19, 19' comprises on each side of the accumulation unit 3 a belt system 23', coupled to respective pulleys and set in counterclockwise rotation by a motor drive 25. Each of the two belts of the belt system 23' (only one side of the accumulation unit 3 is shown in FIG. 13) unwinds along a vertical plane in tangency with small wheels 19*a*, 19'*a* of all fixed rollers 19, 19' of the first and second series, respectively. The belt system 23' is connected to actuators 23*a* which translate it horizontally away from the small wheels 19*a*, 19'*a*, so that the fixed rollers 19, 19', once launched at the appropriate tangential velocity, return to move idly until they come into contact with the strip N.

The launching system 24 of the movable rollers 21, 21' comprises, in turn, on each side of the accumulation unit 3, a belt system 24' coupled to respective pulleys and set in clockwise rotation by a motor drive 26. Each of the two belts of the belt system 24' (only one side of the accumulation unit 3 is shown in FIG. 13) unwinds along a vertical plane in tangency with all movable rollers 21, 21' of the first and second series, respectively, when they are in the retracted condition. When the movable rollers 21, 21' are brought to an extended position, the belt system 24' no longer comes into contact therewith, so that the movable rollers 21, 21' return to move idly until they come into contact with the strip N.

The launching systems 23, 24 are activated only immediately after the step of loading the strip N in the machine 1, i.e., immediately before the contact of the rollers 19, 19', 21, 21' with the strip N, for the reason explained above. When said rollers come into contact with the strip N, the movement of the latter along path P keeps the rollers 19, 19', 21, 21' rotating, which as mentioned are mounted idle.

Figure 14:
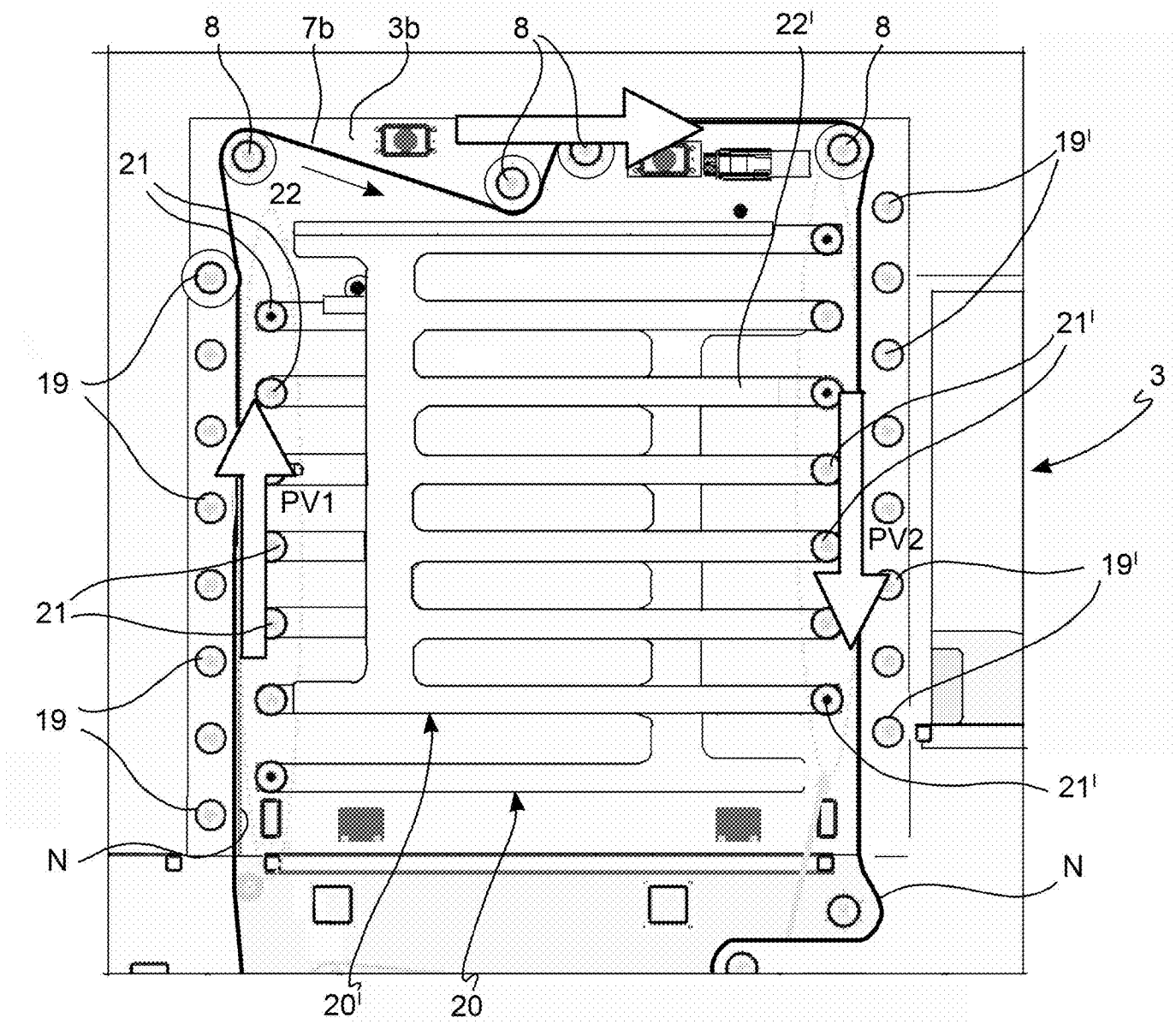
FIGS. 14-16 are diagrammatic side section views of the storage store in FIG. 12 in an operational sequence.

FIG. 14 illustrates the operational condition of the accumulation unit 3 during the step of loading the strip N described above. The strip N, driven by the accompanying bar 9 (not shown) along the path P indicated by the arrows, passes between the fixed rollers 19, 19' and the movable rollers 21, 21', which are stationary now.

Figure 15:
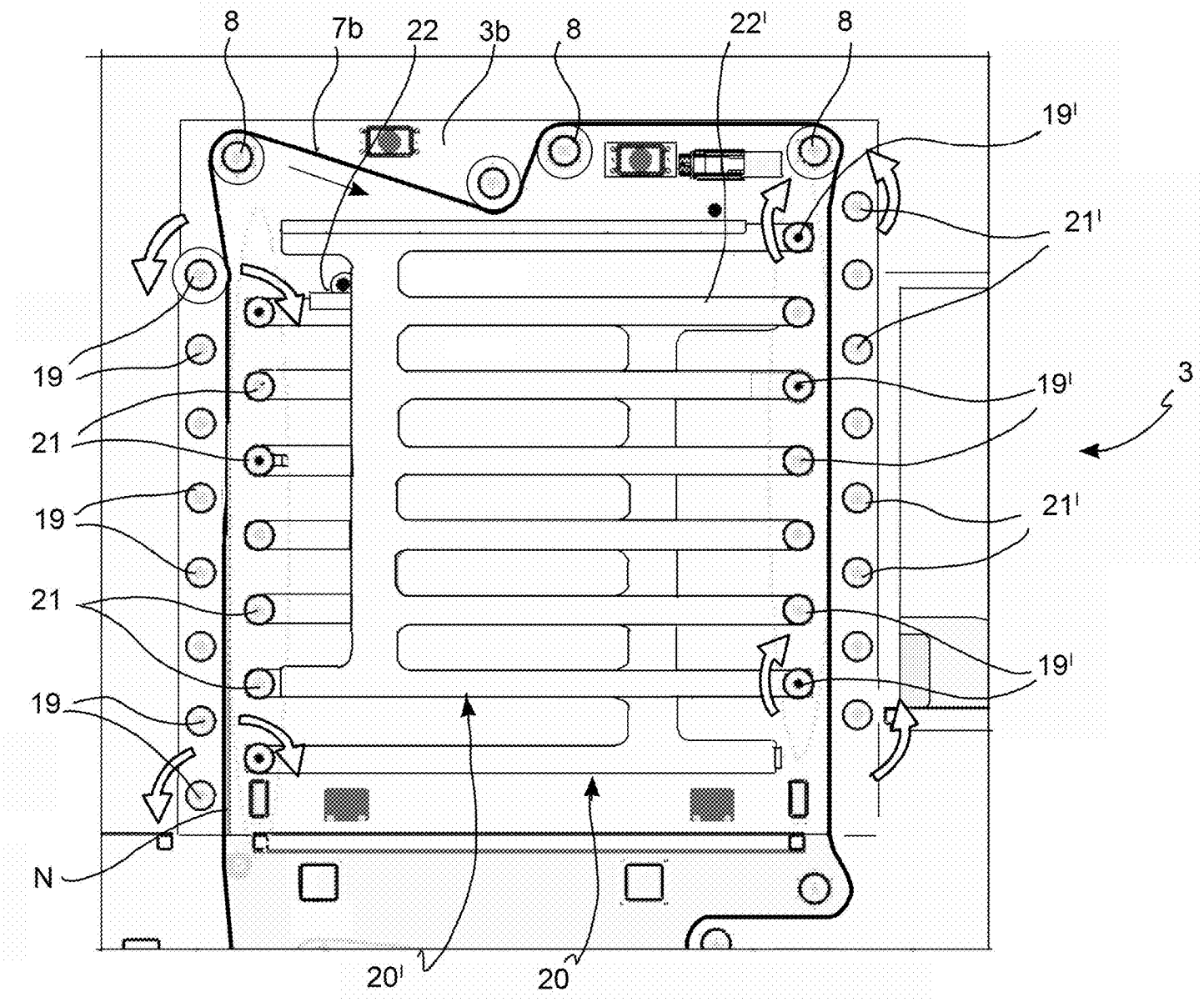

FIG. 15 illustrates the next step, in which the loading of the strip N is completed, and the fixed 19, 19' and movable 21, 21' rollers are set in rotation by the respective launching systems 23, 24. The arrows indicate the rotation direction: clockwise for the movable rollers 21, 21' and counterclockwise for the fixed rollers 19, 19'.

Figure 16:
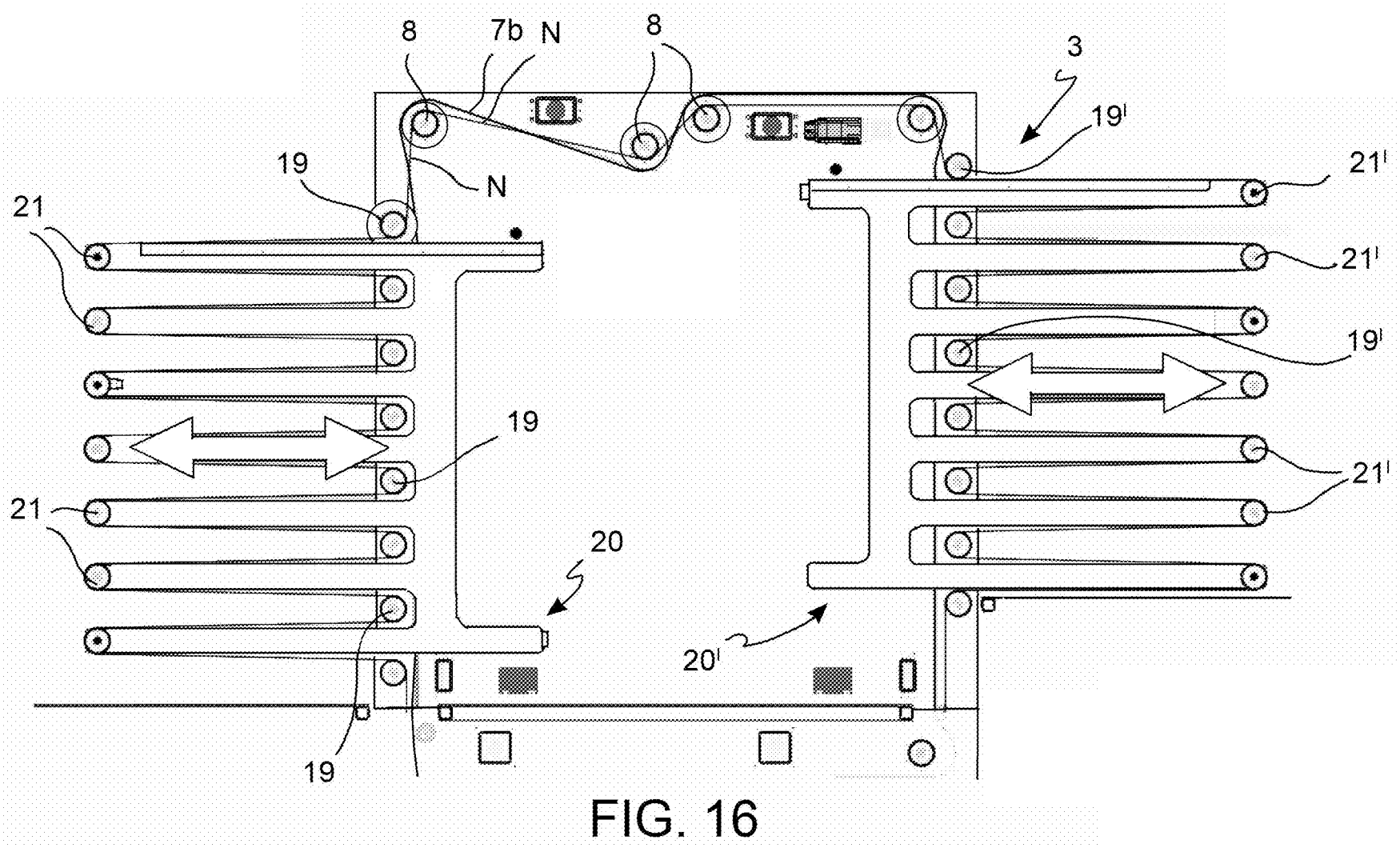

Finally, FIG. 16 illustrates the next step in which the machine 1 is in a normal operational condition. The movable rollers 21, 21' are moved forward to an extended position, introducing themselves between two contiguous fixed rollers 19, 19' and engaging the strip N so as to extend it to form meanders. The movement of the movable rollers 21, 21' from the retracted position to an extended position and vice versa, as indicated by the arrows, allows modulating the total length of the path P as needed, either by lengthening it (movable rollers 21, 21' in a more extended position) or shortening it (movable rollers 21, 21' in a less extended position), so as to act as a storage store for the strip N during processing, in case of a processing stoppage or slowdown of the downstream in winding unit 4.

The winding unit 4 comprises a rotatable disc 29, which supports two winding shafts 5, 5' of the coils B. In turn, the winding shafts 5, 5' are rotatable by means of an appropriate motorization.

The winding unit 4 further comprises a feeding roller 30 of the strip N to a winding position.

The winding shafts 5, 5' are placed in opposite positions along a diameter of the disc 29, so that 180° rotation of the disc 29 allows taking the first winding shaft 5 or the second winding shaft 5' alternatively to said winding position.

The converting machine 1 according to the present invention thus allows the initially set objects to be achieved.

In particular, the automatic loading system and/or the special arrangement of launching systems for the movable rollers 21, 21' of the accumulation unit 3 also allow subjecting to the converting operation strips N made of particularly delicate, loosely cohesive and/or flaky materials, while not renouncing high productivity related to the automation of the various operations.

However, it should be understood that even if an accumulation unit as described above were to be dispensed with or completely eliminated, the loading unit 2 of the invention alone would allow the automation of loading, without causing breakage or tearing of the strip N made of a delicate material.

It is apparent that only some particular embodiments of the present invention have been described, to which those skilled in the art will be able to make all changes required for the adaptation thereof to particular applications, without departing from the scope of protection of the present invention.

We claim:

1. A machine for converting coils of a material into smaller coils, comprising a loading unit for automatically loading a strip of material into the machine, an accumulation unit of the strip being processed, and a winding unit of the strip on a winding shaft to form respective coils, wherein the loading unit comprises an accompanying system for the strip from the loading unit to the winding unit, said accompanying system being formed by a double chain, comprising a first chain and a second chain and an accompanying bar driven by said first and second chains, wherein the double chain develops as a loop along a path and wherein the accompanying bar is movable along the loop-shaped path and is configured to drive the strip starting from the loading unit to the winding unit and then, after releasing the strip, to return to the starting point in the loading unit, wherein the accompanying system further comprises a non-motorized magnetic bar, which slides idly along the path, wherein, in a rest condition, the magnetic bar is housed in a locking-unlocking device, from which it is picked, during the loading step of the strip, by the accompanying bar, so as to be pushed along the path.

2. The machine according to claim 1, wherein the path is defined by a plurality of idle toothed wheels and at least one motorized toothed wheel.

3. The machine according to claim 1, wherein the accompanying bar is cylinder-shaped and has a circular cross-section, or at least comprises a surface with an arc-shaped cross-section facing towards a sliding direction of the double chain, and is made of, or comprises parts made of, a ferromagnetic material so as to be attracted by a magnet.

4. The machine according to claim 3, wherein, the magnetic bar is associated with a C-shaped element, having a cross-section with a concave profile so as to couple with the accompanying bar during the operational steps of the loading method for a new strip.

5. The machine according to claim 1, wherein the locking-unlocking device of the magnetic bar comprises a lever element, which comprises a body, from a first end of which a locking finger, arranged along an axis X inclined at an angle of less than 90° relative to the longitudinal axis Y of the body, protrudes, the body being hinged, at a midpoint, on a hinge, while, at a second end, the body is fixed to a supporting element of the locking-unlocking device by means of an elastic element, so that the lever element can pivot between an unlocked position and a locked position of the magnetic bar, wherein the lever element is returned to the locked position by the elastic recall of the elastic element.

6. The machine according to claim 1, wherein the accumulation unit comprises:

a first movable supporting structure for a first series of movable rollers and a second movable supporting structure for a second series of movable rollers, wherein each series of movable rollers comprises a plurality of rollers aligned vertically in a plane parallel to a first and second straight path stretches, said first and second straight path stretches being connected by a third upper path stretch, to form as a whole a substantially π-shaped path stretch, which encloses said movable supporting structures underneath, and wherein said first and second movable supporting structures slide in opposite directions away from each other; and a first series of fixed rollers and a second series of fixed rollers, facing the first and second series of movable rollers respectively, but staggered vertically relative thereto, each series of fixed rollers comprising a plurality of rollers aligned vertically, respectively, on a plane parallel to said first and second path stretches and facing one side of said path stretches opposite to said first and second series of movable rollers, on the outside of the π-shaped path stretch so that said path stretches are placed between said fixed rollers and said movable rollers.

7. The machine according to claim 6, wherein the fixed rollers and the movable rollers are idle and are vertically spaced by the same spacing, and wherein the fixed rollers are vertically offset from the movable rollers so that when the latter are placed in an extended position, they fit between two fixed rollers without interfering with them.

8. The machine according to claim 1, wherein the winding unit comprises a feeding roller of the strip at a winding position and a rotatable disc, which supports two winding shafts of coils, the winding shafts being, in turn, rotational in a motorized manner, wherein the winding shafts are placed in opposite positions along one diameter of the disc, so that the 180° rotation of the disc alternatively takes the first or the second winding shafts to said winding position.

9. A method for converting a coil of material wound as a strip into coils of smaller size, wherein said material is preferably a delicate, brittle and/or loosely cohesive material, comprising the steps of:

a) making available a converting machine as defined in claim 1;

b) advancing the accompanying bar until it contacts with a portion of the end of the strip and transporting the end portion of the strip against the magnetic bar to sandwich it between the accompanying bar and the C-shaped element of the magnetic bar;

c) advancing the accompanying bar-magnetic bar assembly together with the strip along said path through the accumulation unit up to the winding unit;

d) separating an end portion of the strip from the rest of the strip, which undergoes winding on a winding shaft, e) advancing the accompanying bar-magnetic bar assembly together with a piece separated from the strip along the path until it returns to the loading unit at the locking-unlocking device; and f) moving the accompanying bar with retrograde motion so as it assumes an initial starting position.

* * * * *